United States Patent [19]

Hansen et al.

[11] Patent Number: 5,000,136

[45] **Date of Patent: * Mar. 19, 1991**

[54] INTERNAL COMBUSTION ENGINE WITH ROTARY VALVE ASSEMBLY

[76] Inventors: Craig N. Hansen, 14222 Bellevue Dr., Minnetonka, Minn. 55343; Paul C. Cross, 1729 James Ave. South, Minneapolis, Minn. 55403

[ * ] Notice: The portion of the term of this patent subsequent to Sep. 27, 2005 has been disclaimed.

[21] Appl. No.: 248,946

[22] Filed: Sep. 23, 1988

Related U.S. Application Data

[63] Continuation-in-part of Ser. No. 899,157, Aug. 22, 1986, Pat. No. 4,773,364, which is a continuation-in-part of Ser. No. 671,573, Nov. 15, 1984, Pat. No. 4,612,886.

[51] Int. Cl.[5] ..... F01L 7/16

[52] U.S. Cl. ..... 123/80 BB; 123/80 D; 123/80 DA; 123/190 B; 123/190 E; 123/307

[58] Field of Search ..... 123/190 R, 190 B, 190 D, 123/190 E, 80 R, 80 BB, 80 D, 80 DA, 657, 659, 671, 307

[56] References Cited

U.S. PATENT DOCUMENTS

| | | | |
|---|---|---|---|
| 1,042,712 | 10/1912 | Moorhead | 123/190 BB |
| 1,061,653 | 5/1913 | Alyea | 123/80 DA |
| 1,170,769 | 2/1916 | Mayfield | 123/190 BD |
| 1,215,993 | 2/1917 | Rimbach | 123/190 A |
| 1,292,597 | 1/1919 | Gill | 123/190 D |
| 1,581,942 | 4/1926 | Rich | 123/190 BB |
| 1,632,517 | 6/1927 | Stickney | 123/190 D |
| 1,651,207 | 11/1927 | Hodges | 123/190 DL |
| 1,692,235 | 11/1928 | Wehr | 123/190 BD |
| 1,700,862 | 2/1929 | Thompson | 123/190 R |
| 1,719,508 | 7/1929 | Good | 123/190 D |
| 1,724,458 | 8/1929 | Davidson | 123/190 BB |
| 1,733,946 | 10/1929 | Meester, Jr. | 123/190 BF |
| 1,758,242 | 5/1930 | Wehr | 123/253 |
| 1,782,389 | 11/1930 | Rauha, Jr. et al. | 123/190 A |
| 1,971,060 | 8/1934 | Wills | 123/190 E |
| 2,017,196 | 10/1935 | Anglada et al. | 123/190 E |
| 2,222,059 | 11/1940 | Monleone | 123/190 D |
| 2,245,743 | 6/1941 | Aspin | 123/190 D |
| 2,395,994 | 3/1946 | Davies | 123/190 C |
| 2,437,181 | 3/1948 | Baker | 123/190 BD |
| 2,471,941 | 5/1949 | Downey | 251/113 |
| 2,500,794 | 3/1950 | Boyce | 123/80 DA |
| 2,730,088 | 1/1956 | Hyde | 123/190 A |
| 3,039,448 | 6/1962 | Stucke | 123/190 D |
| 3,130,953 | 4/1964 | Carpenter | 123/190 D |
| 3,395,680 | 8/1968 | Brooks | 123/190 A |
| 3,906,922 | 9/1975 | Dane | 123/190 B |
| 4,019,488 | 4/1977 | Kremer | 123/190 BB |
| 4,036,184 | 7/1977 | Guenther | 123/190 E |
| 4,311,119 | 1/1982 | Menzies et al. | 123/190 BD |
| 4,404,934 | 9/1983 | Asaka et al. | 123/190 BD |
| 4,467,751 | 8/1984 | Asaka et al. | 123/190 E |
| 4,494,500 | 1/1985 | Hansen | 123/190 E |
| 4,612,886 | 9/1986 | Hansen et al. | 123/190 D |
| 4,773,364 | 9/1988 | Hansen et al. | 123/190 E |
| 4,813,392 | 3/1989 | Hansen et al. | 123/190 E |

FOREIGN PATENT DOCUMENTS

| | | | |
|---|---|---|---|
| 492380 | 3/1954 | Italy | 123/80 D |
| 230329 | 3/1944 | Switzerland | 123/190 D |
| 361591 | 11/1931 | United Kingdom | 123/307 |
| 401985 | 11/1933 | United Kingdom | 123/190 D |

*Primary Examiner*—Craig R. Feinberg

[57] ABSTRACT

An internal combustion engine having a head with valve assemblies for controlling intake and exhaust gases to and from piston chambers. A head plate is located between the head and a block having cylinders accommodating pistons. The head plate has openings in communication with the cylinders and valve assemblies. Each valve assembly has a continuous ceramic sleeve having an intake port, and an exhaust port. Rotatably disposed within the sleeve is a rotatable valve body having a valving combustion chamber open to a piston chamber. A spark plug is mounted on each valve body. A ceramic segment seal mounted on the valving body has sealing surfaces engageable with the sleeve. A face seal is located between the head plate and the rotating valve body. The valving body and seal are rotatably driven to sequentially align the valving combustion chamber with the intake port and exhaust port during the operation of the engine.

51 Claims, 7 Drawing Sheets

INTERNAL COMBUSTION ENGINE WITH ROTARY VALVE ASSEMBLY

CROSS REFERENCE TO RELATED APPLICATIONS

This application is a continuation-in-part of U.S. application Ser. No. 899,157 filed Aug. 22, 1986, now U.S. Pat. No. 4,773,364, which is a continuation-in-part of U.S. application Ser. No. 671,573 filed Nov. 15, 1984, now U.S. Pat. No. 4,612,886.

FIELD OF INVENTION

The invention pertains to an internal combustion engine having a rotary valve assembly with a valving combustion chamber accommodating burning fuel and to control the flow of intake and exhaust gas into and from an expansion chamber in communication with the valving combustion chamber.

BACKGROUND OF INVENTION

Rotary valves have been proposed for use with internal combustion engines. These valves have valving members drivably connected to the crankshafts of the engine to sequentially allow intake gas, such as an air and fuel mixture, to flow into the engine and exhaust gas to flow out of the engine. An example of a rotary valve mechanism for an internal combustion engine is described by Carpenter in U.S. Pat. No. 3,130,953. This valve mechanism has a rotary valve body rotatably located in a head. The head is mounted on top of a cylinder. A self-sealing split sleeve device associated with the body functions as a valving member and seal. The sleeve is a metal cylindrical member having a hole and a longitudinal split. In use the sleeve deforms outwardly into circumferential surface sealing engagement with an inside cylindrical wall of the head to close the intake and exhaust ports. Hodges in U.S. Pat. No. 1,651,207 discloses an internal combustion engine having a rotary valve located over the piston. The valve has a port open to the piston chamber that is sequentially moved into alignment with intake, ignition and exhaust ports. The outer surface of the valve is in surface engagement with the head.

Ceramic materials have been developed for parts of turbine engines and internal combustion engines. Engine designs must accommodate the mechanical, heat, and lubricating characteristics of the ceramic materials. The rotary valve assembly of the present invention has ceramic parts that are compatible with the material of the head, cylinder, and piston of the engine.

SUMMARY OF INVENTION

The invention is directed to an internal combustion engine having rotary valve assemblies and a head plate located between the piston and valve assemblies. The valve assemblies are usable as a substitute for the conventional poppet valves and cam shaft arrangements used in conventional internal combustion engines. The valve assemblies have a simplified construction which can be readily serviced and maintained without major repair of the engines. In operation, the valve assemblies are usable with high speed engines. The conventional problem with valve float associated with poppet valves is not present in the rotary valve assembly.

The internal combustion engine has a block with a plurality of bores accommodating reciprocating pistons. The bores and pistons provide the compression and expansion chambers for accommodating a burning air/fuel mixture and exhaust gases. The rotary valve assemblies located in a head are concurrently driven with a valve drive operatively connected to the crankshaft of the engine. A head plate has openings providing communication between the rotary valve assemblies and the compression and expansion chambers. The head plate reduces the pressure induced thrust forces on the rotary valve assemblies and minimizes the quenched volume of air and fuel mixture adjacent to the valving combustion chambers. Substantially all of the air/fuel mixture in the valving combustion chamber is exposed to the flame front with a result in reduction of HC emissions and improved fuel economy. A spark generating means is mounted on the valve and extended into the valve combustion chamber to ignite the air/fuel mixture in the valving combustion chamber. A fuel injector can be mounted on the head when the engine is a Diesel engine, or in conjunction with spark generating means in the case of a fuel injected spark ignition engine.

The head has a plurality of bores open to the piston compression and expansion chambers in the block. The bores can be larger than the openings in the head plate. Intake and exhaust gas passages located in the head are open to separate portions of each bore. Each bore accommodates a continuous sleeve having an intake port, and an exhaust port. The intake and exhaust ports are aligned with the intake and exhaust gas passages in the head. The intake and exhaust ports have generally rectangular shapes to improve the rate of opening and closing the gas flow area of the ports. The sleeve is a cylindrical member having a cylindrical inner surface. The sleeve can be made of ceramic material or metal.

A rotatable valve means having a combustion chamber open to both the piston chamber and the inner surface of the sleeve is rotatably located within each sleeve. Each valve means includes a rotary valve body located within the sleeve. The bottom of the valve body is located adjacent the head plate with intermediary seal elements to reduce the thrust forces on the valve body minimize crevice volumes. A pressure activated seal is interposed between the head plate and bottom of the valve body. The opening in the head plate connects the valving combustion chamber with the piston chamber. The valve body has an outside cylindrical wall positioned in spaced contiguous relationship to the inside wall of the sleeve. The valve body is rotatably mounted on the head with low friction bearings. The valve body has a rotatable valving combustion chamber for accommodating air/fuel mixture and exhaust gases. A spark plug is mounted on the valve body with spark elements within the valving combustion chamber. A segment seal mounted on the valve body is located in sealing relation with the inside surface of the sleeve. Segment seal is a ceramic member or wear resistant metal drivably mounted on the valve body. The segment seal has a range of radial and pivotal movement so that it can freely maintain sealing engagement with the inner surface of the sleeve. The segment seal has upper and lower pivot pins that extend into notches in the valve body. The pins allow the segment seal to pivot about an axis that is parallel to the inner surface of the sleeve. The segment seal includes a pressure activated ring seal which bears against the valve body to provide a gas-tight seal at a minimum of friction of the segment seal with the sleeve and allows for the less stringent machining tolerances of the valve body.

The rotary valve assembly provides for an air/fuel stratification in the valving combustion chamber when fuel is mixed with the air during the compression stroke intake. This enhances the ignition of the air/fuel mixture and allows for an overall relatively lean air/fuel mixture. The rotary valve body causes circulation and turbulence of the air/fuel mixture in the piston chamber. Pre-ignition and end-gas detonations are reduced.

The rotary valve assemblies can be directly removed from the head. The head and its attendant intake and exhaust manifolds and cooling system need not be removed from the engine in order to provide access to the valve assemblies. Neither initial installation nor accumulated wear affects require adjustment of the valve parts. All fits and clearances are established by manufactured dimensions such that the initial assembly consists of simple synchronization indexing of the valve drive shaft and valve bodies.

DESCRIPTION OF PREFERRED EMBODIMENTS

Figure 1:
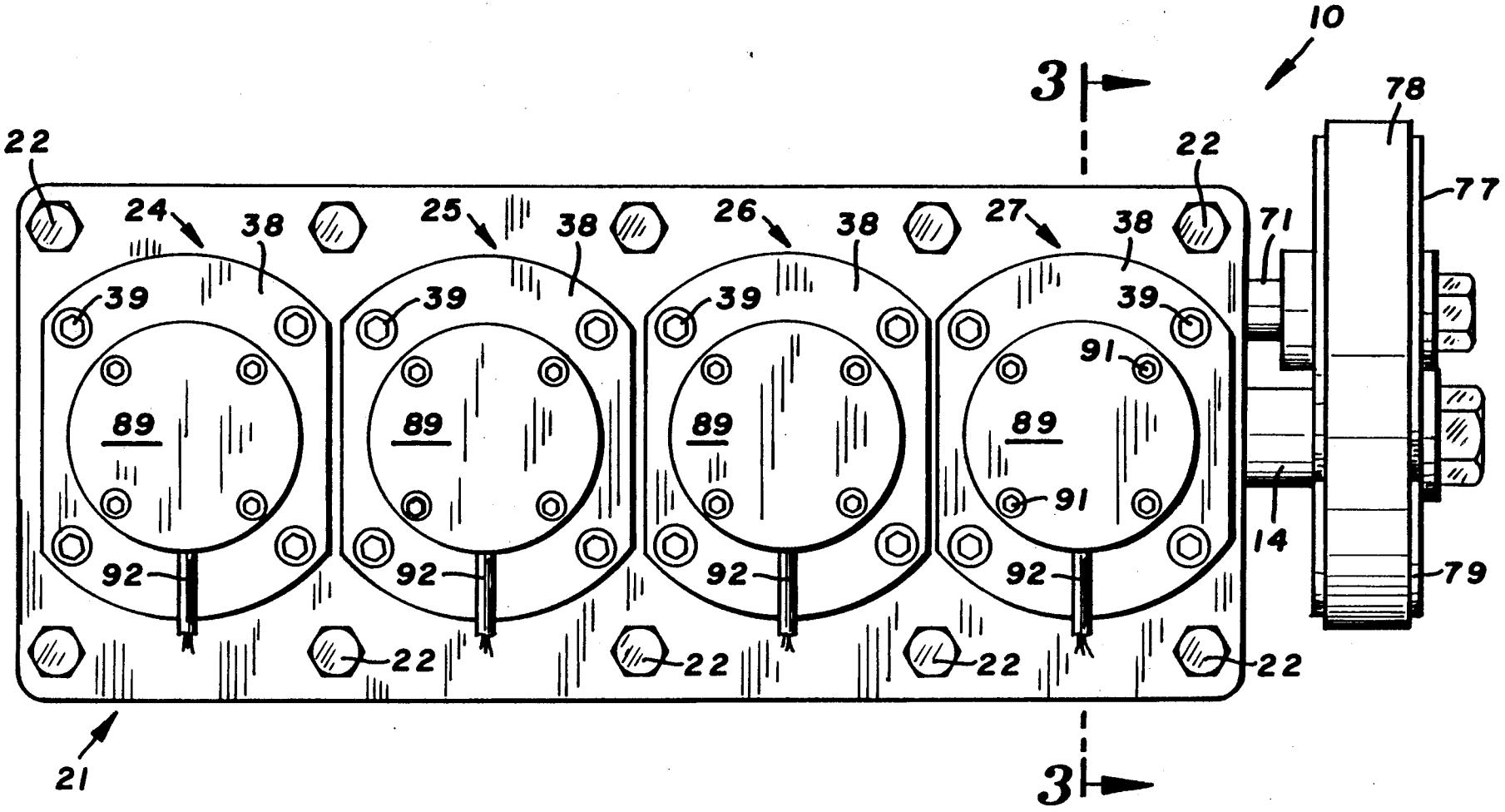
FIG. 1 is a top view of an internal combustion engine equipped with rotary valve assemblies of the invention.
Figure 2:
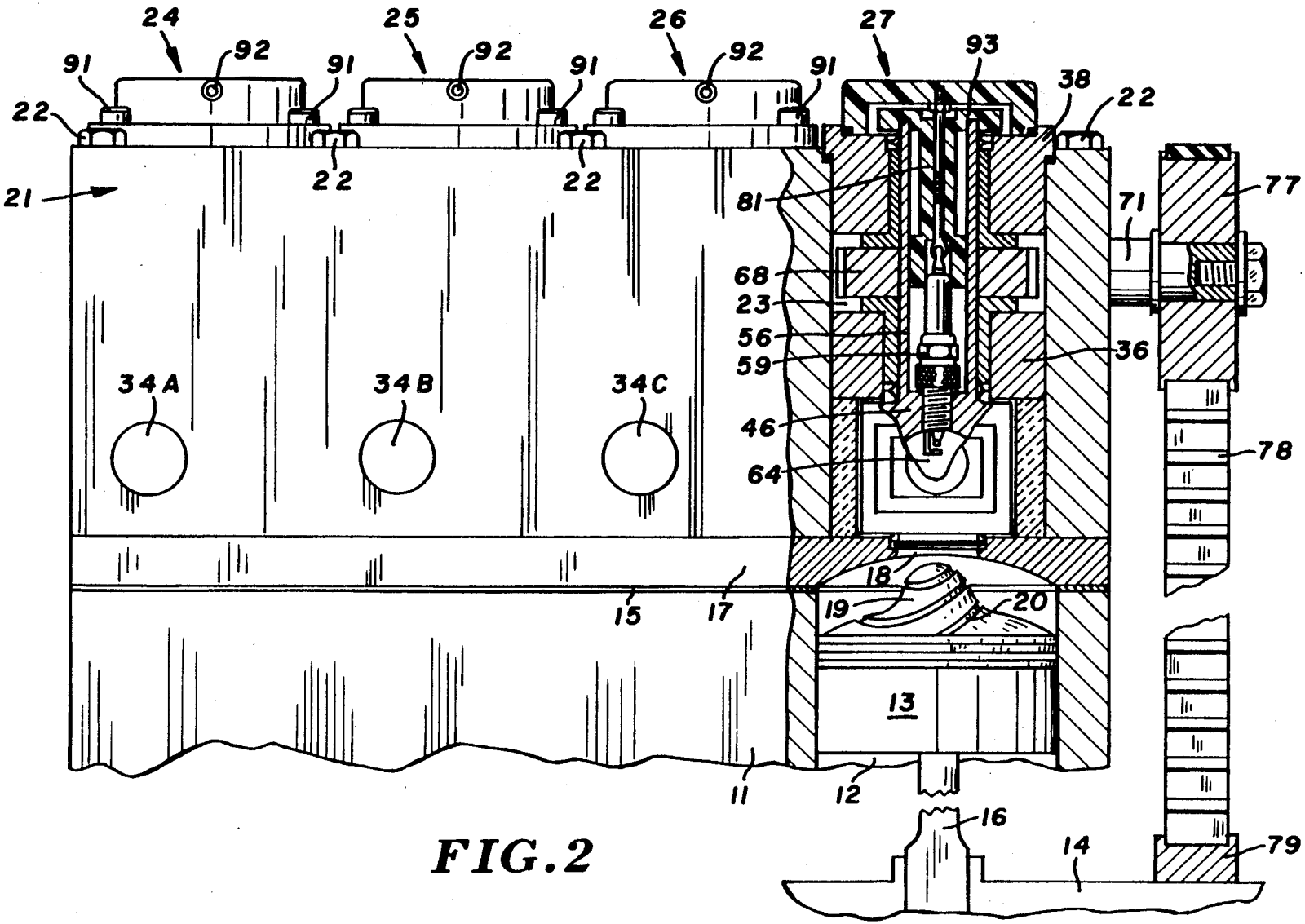
FIG. 2 is a side view, partly sectioned, of the engine of FIG. 1.

Referring to FIGS. 1 and 2, there is shown a four cycle internal combustion engine indicated generally at 10 equipped with rotary valve assemblies 24, 25, 26 and 27 having rotary valving combustion chambers. The air/fuel mixture introduced into the rotary valving combustion chambers stratifies to allow effective ignition in lean burn environments. The air/fuel mixture in the rotary combustion chambers has circulation and turbulence providing an effective and efficient propagation of the flame front in the valving combustion chamber and expansion chamber. Engine 10 has a block 11 containing four upright cylinders or bores 12. The number of bores in block 11 can vary according to the design of the engine. Each of the bores 12 accommodates a reciprocating piston 13 having conventonal piston rings. Piston 13 is slidably located in bore 12 providing an expansion chamber when piston moves in its intake and power strokes. Each piston connected to a conventional crankshaft 14 with a connecting rod 16. As shown in FIG. 2, a flat metal head plate 17 is located on top of block 11. A gasket 15 is located between the bottom of plate 17 and the top of block 11. Block 11, head plate 17, and head 21 can be a one peice structure, such as cast metal. Bores 12 and 23 in the one peice structure can be machined on opposite sides of the head plate portion of the structure. This eliminates gasket 15 as the head plate is integral with block 11. Head plate 17 has a circular opening 18 aligned with the central vertical axis of bore 12. An opening in head plate 17 is aligned with but not necessarily concentric with each bore in block 11. Head plate 17 reduces the thrust forces on the valve assemblies and reduces the quenched volume of the air/fuel mixture adjacent to the valving combustion chambers. Substantially all of the air and air/fuel mixture in the valving combustion chambers are exposed to flame fronts with a result in reduction of HC emissions and improved fuel economony. Piston 13 has an upwardly directed central projection 19 that is located in opening 18 when piston 13 is at top dead center or at the completion of the compression stroke and exhaust stroke. Projection 19 increases the compression of the air/fuel mixture in the rotary valving combustion chamber, and facilitates a generally cylindrical expanding flame front over the top of piston 13 during the power stroke. Projection 19 may have a plurality of helical grooves 20 to induce swirl or turning motion to the air/fuel mixture and burning fuel in the combustion and expansion chambers. Pistons without projections 19 can be used in the internal combustion engine.

A head indicated generally at 21 is located on top of head plate 17. A plurality of head bolts 22 secure head 21 and head plate 17 to block 11. Head 21 has a plurality of vertical bores 23 accommodating rotary valve assemblies indicated generally at 24, 25, 26 and 27 for directing the flow of air/fuel mixture into the rotary valving combustion chambers, exposing the air/fuel mixture to an ignition spark, directing the burning and expanding gases into the expansion chambers and controlling the flow of exhaust gases out of the valving combustion chambers and expansion chambers. Rotary valve assemblies 24, 25, 26 and 27 are identical in structure and function. The following description is directed to rotary valve assembly 27.

Figure 3:
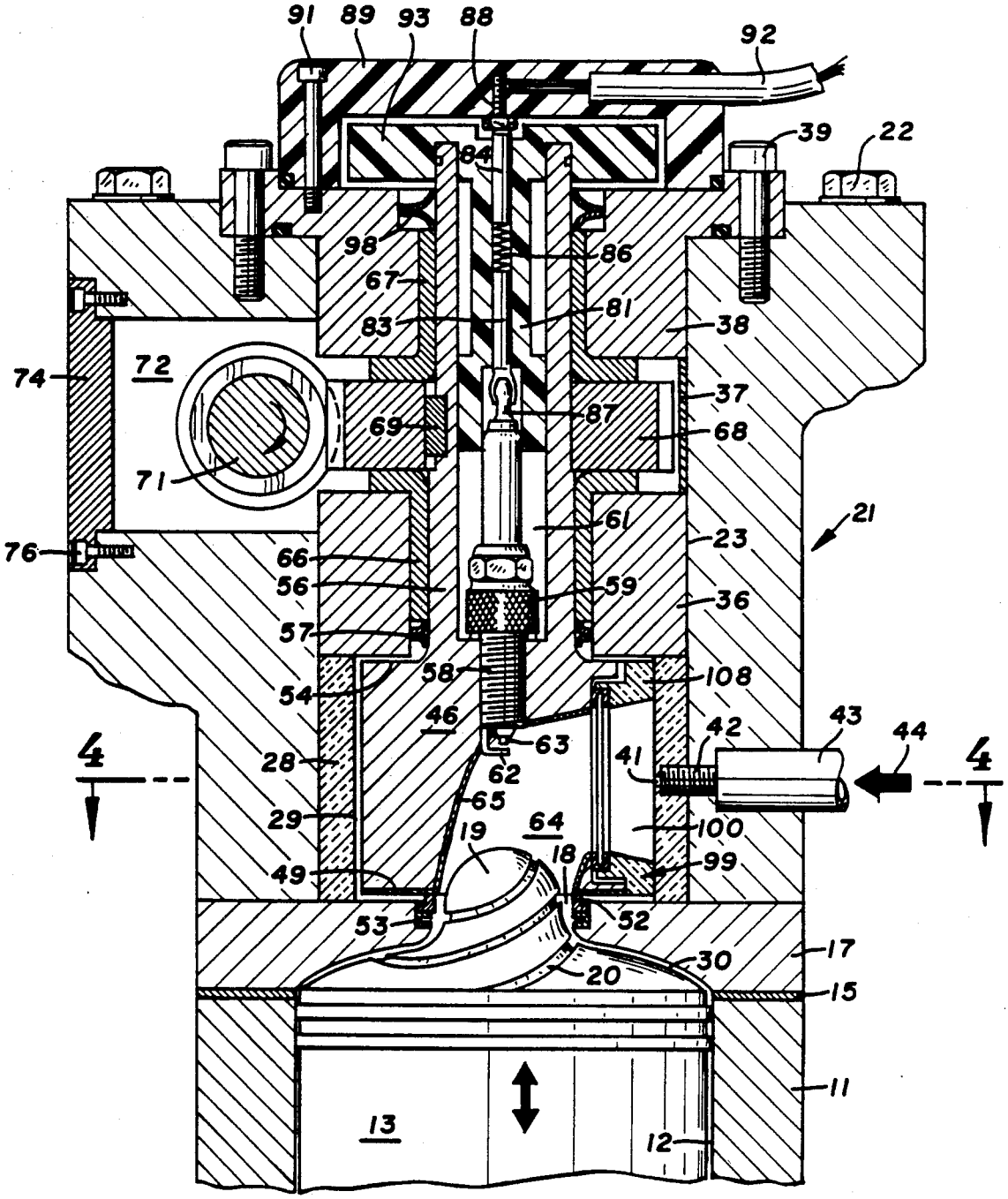
FIG. 3 is an enlarged sectional view taken along the line 3—3 of FIG. 1.
Figure 4:
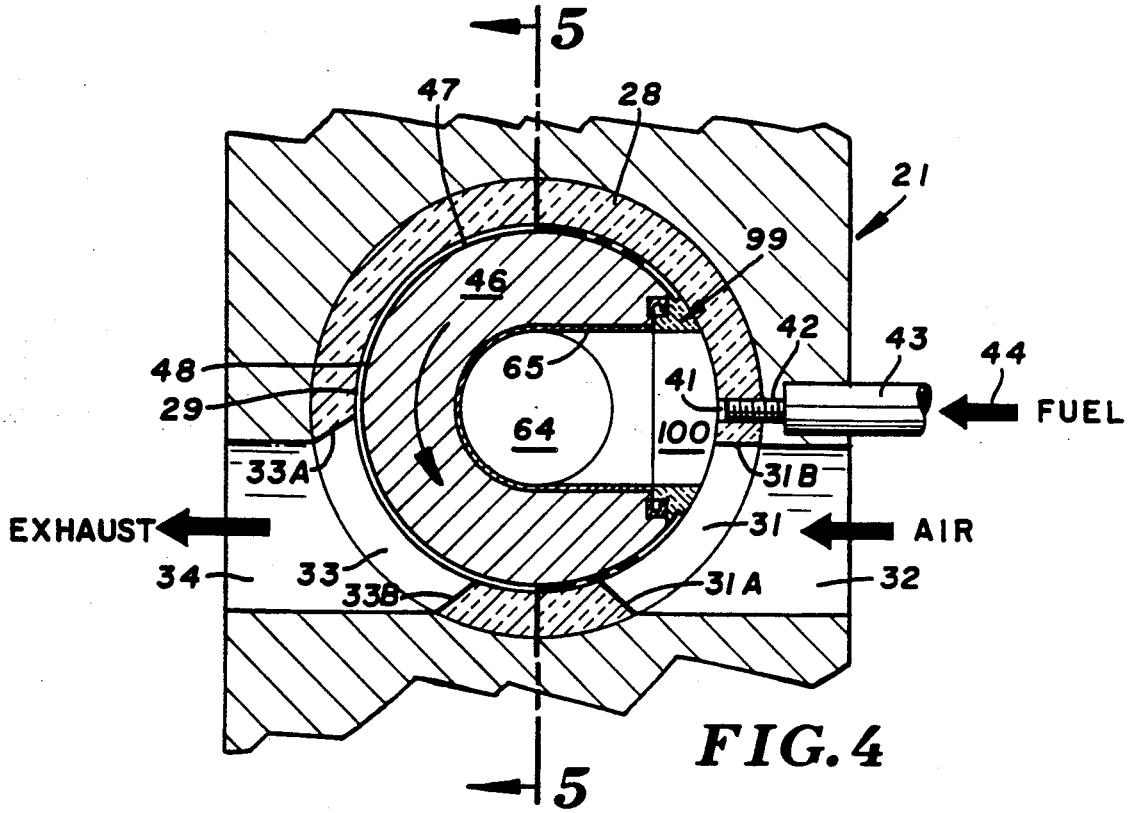
FIG. 4 is a sectional view taken along the line 4—4 of FIG. 3.

Referring to FIGS. 3 and 4, rotary valve assembly 27 has a cylindrical sleeve 28 positioned in the bottom of bore 23. The lower end of sleeve 28 bears against the top of head plate 17. Sleeve 28 is a circular cylindrical member having an inside cylindrical surface 29, an intake port 31, and exhaust port 33. Intake port 31 is aligned with intake passage 32 located in head 21. Exhaust port 33 is aligned with exhaust passage 34 in head 21 opposite passage 32. Sleeve 28 can be removed from bore 23 to facilitate servicing and repair of the engine. The location of the circumferentially spaced edges 31A, 31B and 33A, 33B of sleeve 28 forming intake port 31 and exhaust port 33 can be changed to adjust the timing of the valve events. Replacement of sleeve 28 with an alternative sleeve which has appropriate port edge locations allow the engine to be designed for different efficient operating speeds. Sleeve 28 can be a ceramic material, such as silicon nitride, silicon carbide, or a ceramic including silicon, aluminum, oxygen, nitrogen, and other martials. A sleeve 28 of ceramic material functions as a heat insulator to restrict the dissipation of heat to head 21. Sleeve 28 can also be made of other materials, such as metal, carbon or the like.

Returning to FIG. 2, head 21 has additional exhaust passages 34A, 34B, and 34C for the rotary valve assemblies 25, 26 and 27. Additional intake passages are located in the opposite side of head 21. Intake and exhaust manifolds (not shown) are used to supply an air/fuel mixture or air to the intake passages 32 and carry exhaust gases from exhaust passages 34, 34A, 34B and 34C to an emission control and sound suppression device open to atmosphere. Returning to FIG. 3, sleeve 28 is held in a fixed position against head plate 17 by ring 36 and spacer sleeve 37 located in bore 23. A cap 38 engagable with sleeve 37 holds ring 36 and sleeve 37 and sleeve 28 in bore 23. Cap 38, sleeve 37, ring 36, and sleeve 28 can be machined from a single piece of material. A plurality of bolts 39 secure cap 38 to the top of head 21. Cap 38 is removable from head 21 to allow the entire valve assembly to be withdrawn from block 11 or removal of the intake and exhaust manifolds.

Sleeve 28 has a fuel inlet port 41 located adjacent the air inlet port 31. Port 41 is aligned with a threaded bore 42 in head 21. A fuel injector 43 is located in bore 42 and threaded into the port 41 so that fuel can be injected directly into the combustion chamber. The fuel injector can be mounted on head 21 so that the fuel is injected into the inlet port 31 immediately. Alternatively, the fuel injector can be mounted on head 21 so that the fuel is injected about midway or any intermediate location between the inlet port 32 and the outlet port 33. The fuel is supplied under pressure to fuel injector 43 as indicated by arrow 44 in FIG. 4. The details of the fuel injector are not specifically described as they do not form part of this disclosure. An example of a fuel injector is shown in U.S. Pat. No. 4,033,507.

A cylindrical valve body 46 is located within sleeve 48. Body 46 has an outside cylindrical wall 47 positioned in spaced continguous relation relative to inside wall 46 of sleeve 48. An annular cylindrical space 48 separate the outside cylindrical wall 47 from the inside wall 29 of sleeve 28. Sleeve 28 surrounds the entire outside of body 46. Wall 47 of body 46 does not have a precise machine finish as it does not engage wall 29 of sleeve 28. In other words there is no frictional relationship between walls 46 and 29. The bottom of body 46 has a flat bottom surface 49 facing the head plate 17. Surface 49 can have a ceramic coating to enhance its wear characteristics. The entire body 46 can be made from a ceramic. The walls surrounding chamber 64 have a coating layer 65 of ceramic material.

Figure 5:
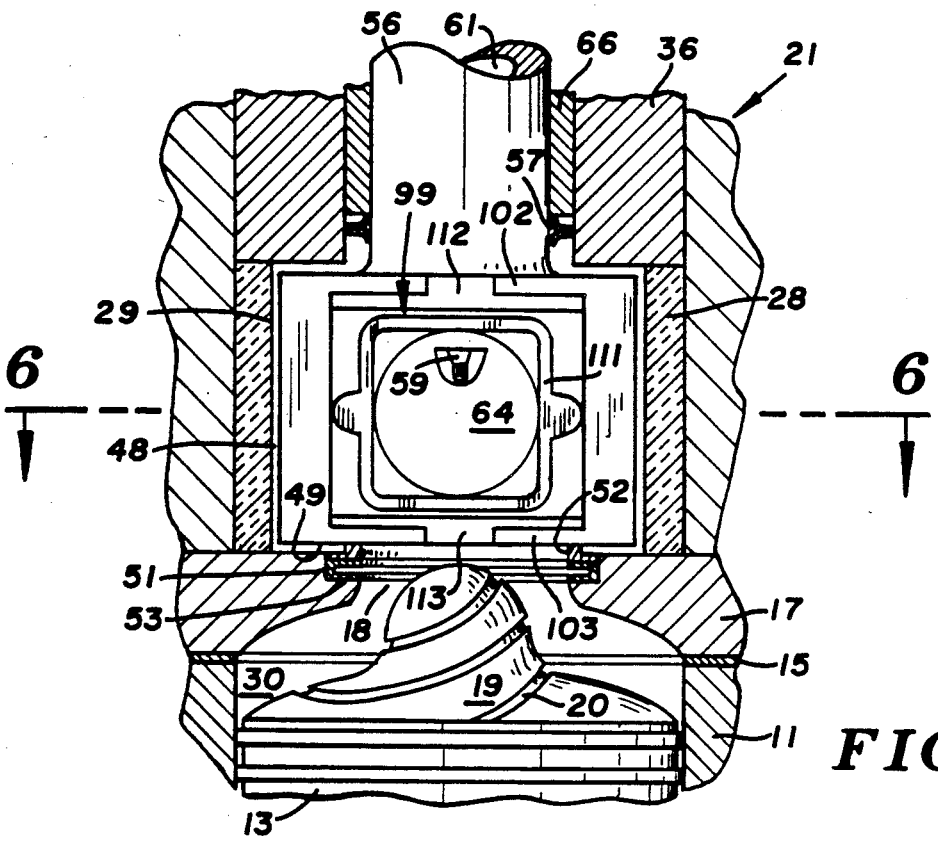
FIG. 5 is a sectional view taken along the line 5—5 of FIG. 4 showing the full front face of the rotary valve.

As shown in FIGS. 3 and 5, head plate 17 has an annular groove 59 surrounding opening 18. A ring seal 52 located in groove 51 is biased with a circular spring 53 into engagement with the bottom surface 49 of the valve body 46. The outer edge of seal 52 has radial projections to prevent turning of the seal with the valve body 46. Seal 52 is a pressure active face seal that has a high unit load on bottom surface 49 during tho compression and power strokes of piston 13. The high unit load is effected by transfer of high pressure gasses into the annular space surrounded by circular spring 53. Seal 52 is preferrably made of ceramic material to enhance its wear and temperature characteristics. Alternatively, a split ring located in an annular groove in head plate 17 and engagable with seal 52, along with a spring in the groove, can be used to hold seal 52 in sliding sealing engagement with the bottom surface 49 of valve body 46.

Valve body 46 has a generally flat top wall 54 facing the bottom of member 36. An upright tubular shaft or stem 56 is intergral with the center portion of top wall 54 and extends upwardly through the ring 36 and cap 38. Bearings 66 and 67 surrounding shaft 56 rotatably mount the shaft on ring 36 and cap 38. A lip seal 57 is interposed below bearing 66 and has sealing engagement with the outside surface of the shaft 56. The center of body 46 has an upright threaded bore 58 that accommodates the threaded end of a spark plug 59. The spark plug 59 is located within the upright passage 61 of shaft 56 in the longitudinal or rotational axis of valve body 46. The lower end of spark plug 59 has spaced electrodes 62 and 63 located in center portion of the top of combustion chamber 64 within valve body 46. Shaft 56 is rotated with a gear 68 located between ring 36 and cap 38. A key 69 secures and indexes gear 68 to shaft 56. A worm gear or spiral-drive 71 logitudinally extended along the length of head 21 in a side horizontal chamber 73 functions to simultaneously rotate all of the gears 68 thereby concurrently rotate all of the valve bodies of the engine at a one-half of engine crank shaft speed. A cover plate 74 conceals worm gear 71 within chamber 72. A plurality of bolts 76 secure cover plate 74 to head 21. As seen in FIG. 2, worm gear 71 is rotated with a belt and pulley power transmission from crank shaft 14. A driven pulley 77 is mounted on the outer end of worm gear 71. A timing belt 78 operatively connects pulley 77 to a driven pulley 78 mounted on the crank shaft 14. Other types of power transmitting structures, such as gears or roller chains can be used to rotate valve bodies 46 in a 2 to 1 timing relation with the rotation of the crank shaft.

A sleeve 82 for ignition rotor 81 extends down into passage 61 of shaft 56. As shown in FIG. 3, sleeve 82 has a vertical hole 82 that accommodates a pair of conductor rods 83 and 84 biased from each other with a coil spring 86. Sleeve 81 is nonconducting material, such as plastic. The lower end of sleeve 81 fits over the top of spark plug 59 so that conductor 83 engages the top conductor 87 of the spark plug. Conductor 84 contacts the head of a bolt 88 secured to an ignition cover 89. Cover 89 is an inverted cup-shaped rigid plastic member. A plurality of bolts 91 secure ignition cover 89 to the top of cap 38. As shown in FIG. 1 ignition wires or cables 92 connect ignition cover 89 to the ignition system (not shown) of the engine. Ignition system can be a conventional distributor coil circuit. Cable 92 contain wires that are electrically connected to the bolt 88. A seal 98 is located between the top of cap 38 and the top of shaft 56 below the head 93 to prevent contamination of bearing 67.

Returning to FIG. 3, sleeve 81 has a generally circular head 93 located below ignition cover 89. An annualar electric conductor or slip ring 94 is secured to the bottom of head 93. Conductor 94 is engaged by a brush 96 biased upward into engagement with slip ring 94 with spring 97. Slip ring 94 and brush 96 completes the electrical circuit between valve body 46 and head 21. Other structures and conductor arrangements can be used to complete the circuit for the ignition system.

Figure 6:
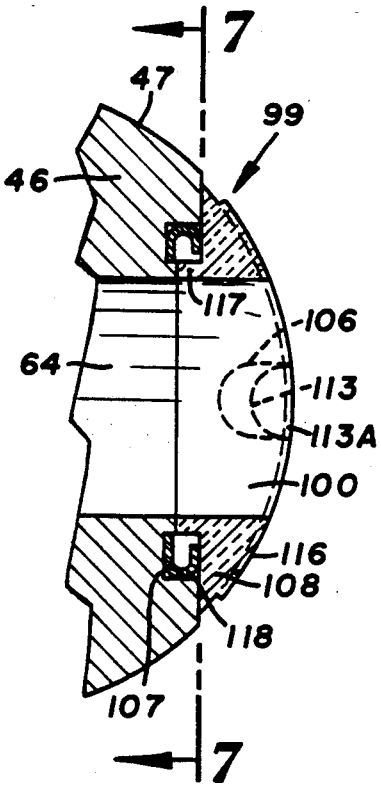
FIG. 6 is an enlarged sectional view taken along the line 6—6 of FIG. 5.
Figure 7:
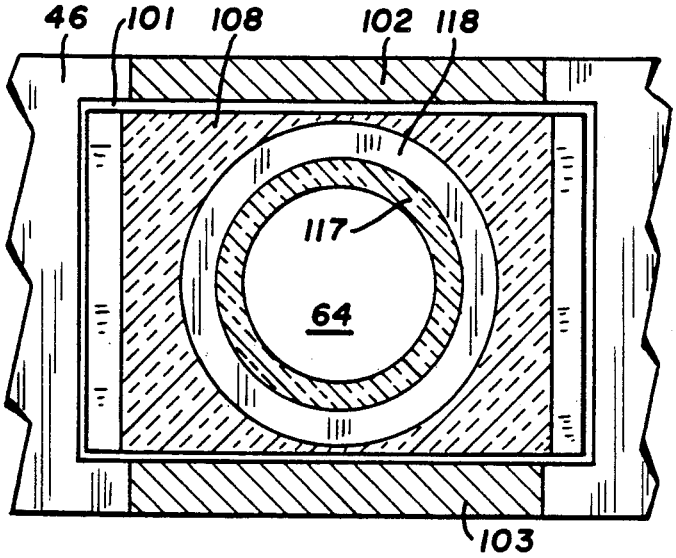
FIG. 7 is an enlarged sectional view taken along line 7—7 of FIG. 6.
Figure 8:
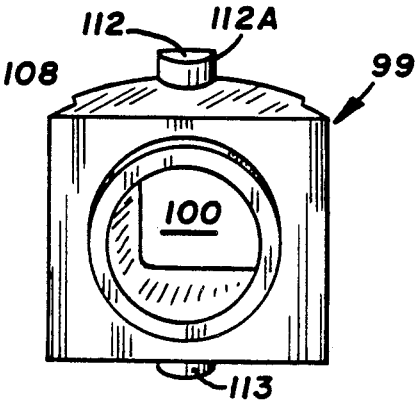
FIG. 8 is perspective view of segment seal of the rotary valve as seen from the back side thereof.
Figure 9:
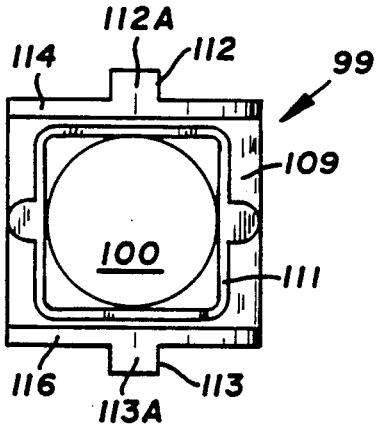
FIG. 9 is a front view of the outside face of the segment seal of the rotary valve.
Figure 10:
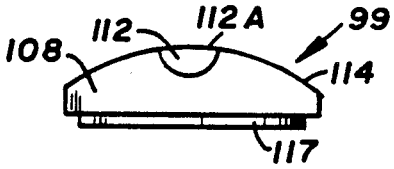
FIG. 10 is a top view of the segment seal of the rotary valve.
Figure 11:
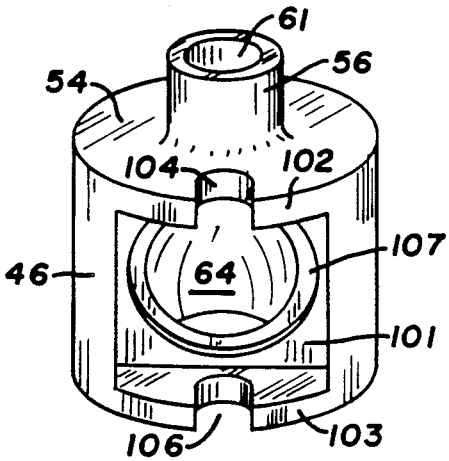
FIG. 11 is a perspective view of the valve body of the rotary valve.

As shown in FIGS. 4, 5, and 6, a segment seal 99 having a passage 100 is mounted on valve body 46 in alignment with the inlet of the combustion chamber 64. The segment seal 99 engages the inner surface 29 of sleeve 28 to provide an effective low friction seal. The valve body 46 has a front pocket 101 that accommodates segment seal 99. Outwardly directed arcuate lips 102 and 103 are located above and below pocket 101. Lip 102 has a recess 104 aligned with a recess 106 in lip 103. The back wall of the pocket 101 has a counter bore 107 surrounding the passage of 100.

Segment seal 99 has a body 108 of ceramic, metal or like material. Body 108 has an outer convex face 109 that has a generally rectangular contact surface 111 surrounding the inlet of the passage 100. Oppositely directed tongues or posts 112 and 113 are secured to the top and bottom portions of body 108. A top land 114 is concentric with the outer surface 112*a* of post 112. A bottom circumferential land 116 is concentric with the outer surface 113*a* of post 113. The lands 116, 111, and 114 and post surfaces 112*a* and 113*a* have the same radius of curvature. This radius of curvature is slightly larger than the radius of curvature of the outer surface 47 of the valve body 46. The radius of curvature of lands 114 and 116 and post surfaces 112*a* and 113*a* is complementary to the radius of curvature of the inner surface 29 of sleeve 28. The back side of body 108 has a cylindrical boss 117 that fits into counter bore 107. A seal 118 is located in counter bore 107 as seen in FIG. 6, to bias segment seal 99 into sealing engagement with the inner surface 29 of sleeve 28 and seal the small space between the inner side of body 108 and the valve body 46.

Returning to FIGS. 1 and 2, the valve body drive is operable to rotate worm gear 71 thereby simultaneously turn the valve bodies in a two to one time relation with the rotation of crank shaft 14. Worm gear 71 is rotatably mounted on head 21 with suitable bearings (not shown) and has helical threads or worm threads in driving engagement with gear 68 and the gears for the other valve bodies to concurrently turn valve bodies 46. The valve bodies of the engine are identical in structure to the valve body shown in FIGS. 3 to 11 including segment seal 99 carried by valve body 46. Each valve body 46 has a combustion chamber or passage 64 for carrying air/fuel mixture to the piston compression and expanson chamber 18 and exhaust gases therefrom. Chamber 64 is open to passage 100 and expansion chamber 30 via opening 18 in head plate 17. Segment seal 99 has outer contact surfaces or the lands 114 and 116 and a generally rectangular rim seal surface 111 that are in sliding sealing contact with inside surface 29 of sleeve 28. The remaining outer surface of body 108 is relieved. In other words, only land 114 and 116 and surface 111 are in surface contact with inner surface 29 of sleeve 28. The entire outer surface 47 of valve body 46 is separated by space 48 from inner surface 29 thereby minimizing the resistance to rotation of valve body 46 within sleeve 28. Seal 118 is a pressure activated annular seal that provides sealing forces proportional to the pressure acting on the seal. When the sealing forces increase, the contact unit loads increase correspondingly at all segment seals inerfaces. Conversly, as the pressure acting within the segment seal decreases, the sealing forces and resulting unit loads decrease. Seal 118 is free to move to accommodate relatively run out between valve body 46 and ported sleeve 28 such that segment seal 99 maintains constant surface contact with inside surface 29 of sleeve 28. Segment seal 99 ensures that the annular clearance 48 between valve body 46 and sleeve 28 is not filled with a fuel/air mixture. This substantially reduces the unburned fuel/air mixture in combustion chamber 64. When passage 100 in combustion chamber 64 is aligned with the intake port 31 intake air is supplied to the valving chamber 64 and the expansion chamber 31 as the piston is moving down in chamber 30. As valve body 46 continues to rotate and piston 13 moves in an upward or compression stroke, the fuel injector 43 introduces a seleced amount of fuel into the valving combustion chamber 64 via port 41 in sleeve 28. The piston 13 as it moves upwardly compresses the air fuel mixture in valving combustion chamber 64. As piston 13 moVes to head dead center, projection 19 moves up through opening 18 into valving combustion chamber 64 as seen in FIG. 3. The ignition system operatively coupled to spark plug 59 is then operated to generate a spark in valving combustion chamber 64. The air fuel mixture in chamber 64 commences to burn with a frame front emanating from spark plug contact point area 62, 63. The rotating valve body 46 with the combustion chamber 64 provides for stratification of the air-fuel mixture due to the centrifical effects of the richer portion of the mixture which is burned by the flame as it moves through the combustion chamber 64. The grooves 20 and projection 19 on the piston head 13 also provides for swirling and turbulant movement of the air/fuel mixture in the valving combustion chamber 64. This reduces detonation and enhances the efficient combustion of the air/fuel mixture in chamber 64. Seal 52 prevents the air/fuel mixture from entering annular space 48 surrounding the valve body 46. This seal is a pressure activated seal which floats with respect to the valve body 46.

The geometry of combustion chamber 64 allows for the intake and exhaust gasses to flow to and from the working or piston chamber 30 with minimal restrictions. Opening 18 in head plate 17 is not restricted so that the burning fuel and expanding gases freely flow into and out of piston chamber 30.

Valve body 46 along with spark plug 59 can be removed as a unit from the head 21. The screws 39 attaching cap 38 to head 21 are removed. Valve body 46 along with spark plug 59, ring 36 and cap 38 are removed as a unit from head 21. The intake in exhaust manifolds and ignition system for the engine as well as parts of the cooling system are not disturbed during the removal and servicing of the valve assembly.

Figure 12:
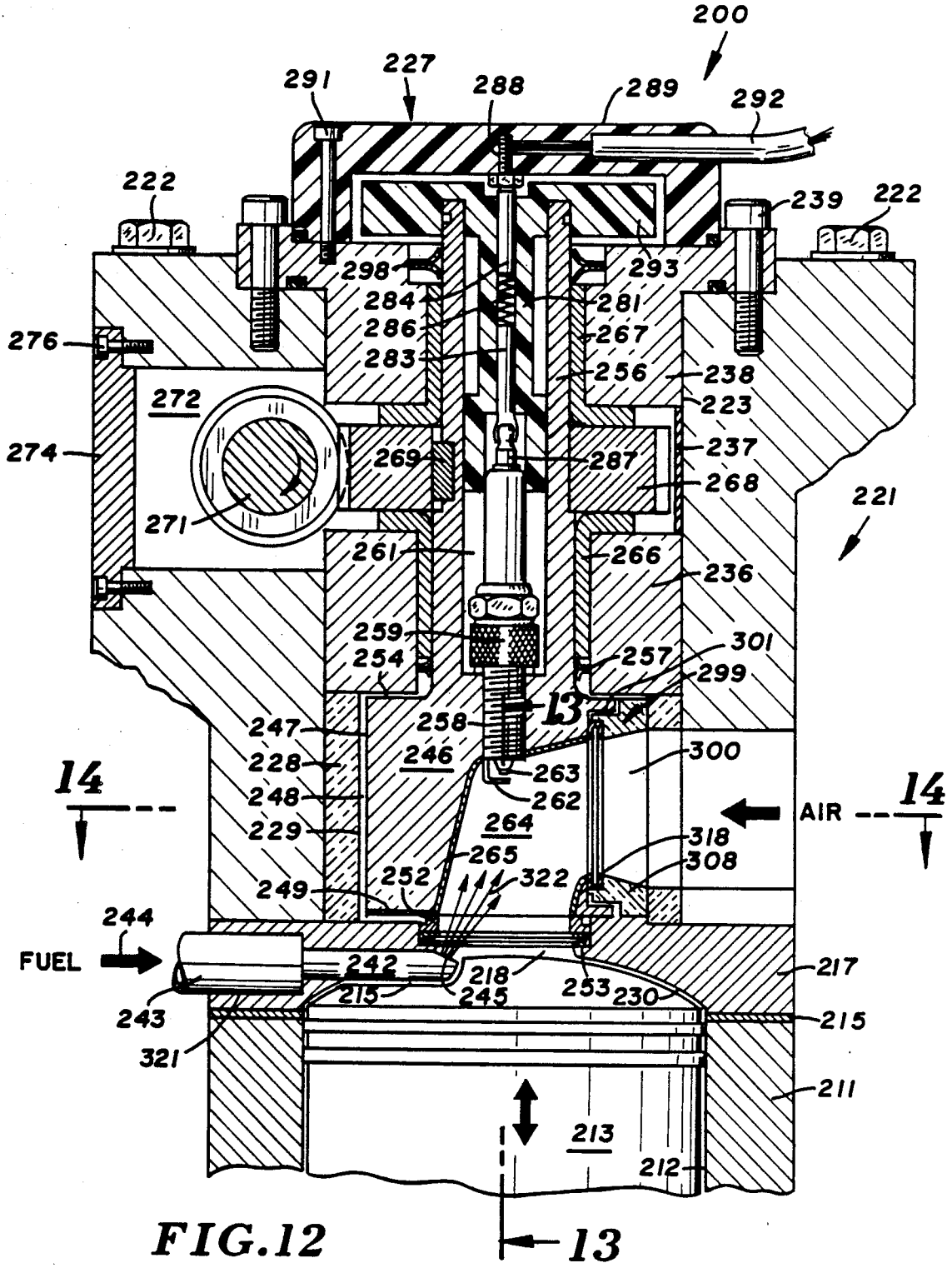
FIG. 12 is a sectional view similar to FIG. 3 of a modification of the engine and rotary valve thereof.
Figure 13:
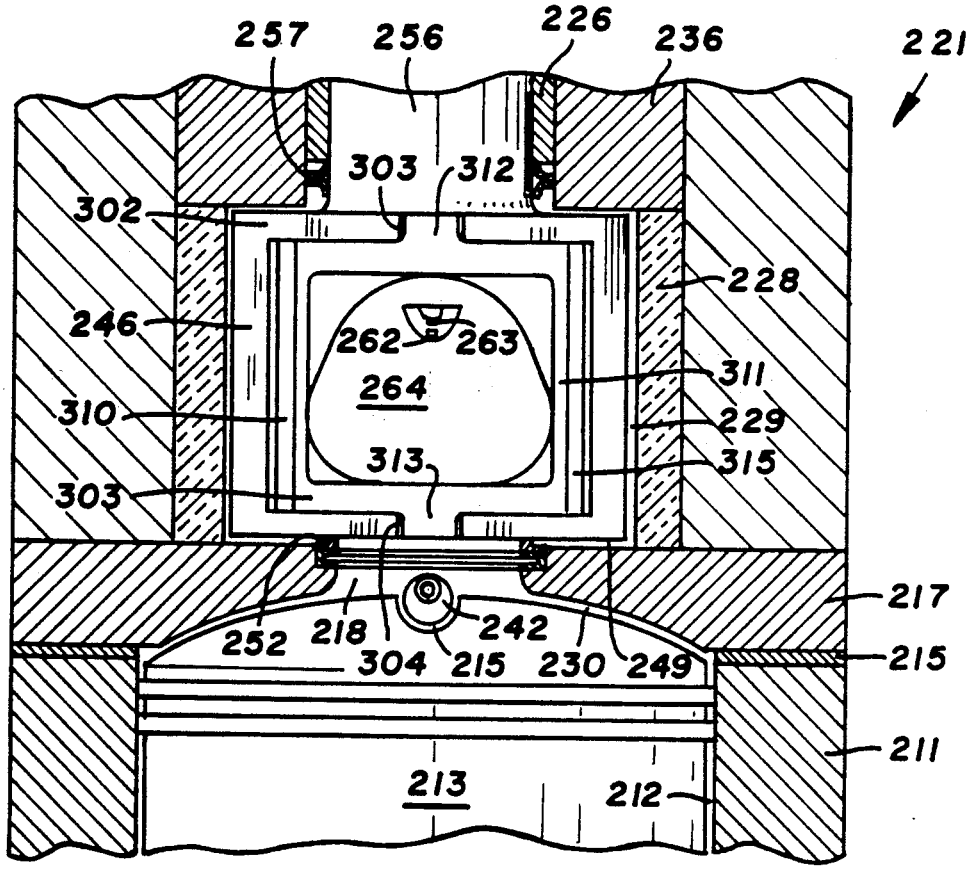
FIG. 13 is an enlarged sectional view taken along line 13—13 of FIG. 12.
Figure 14:
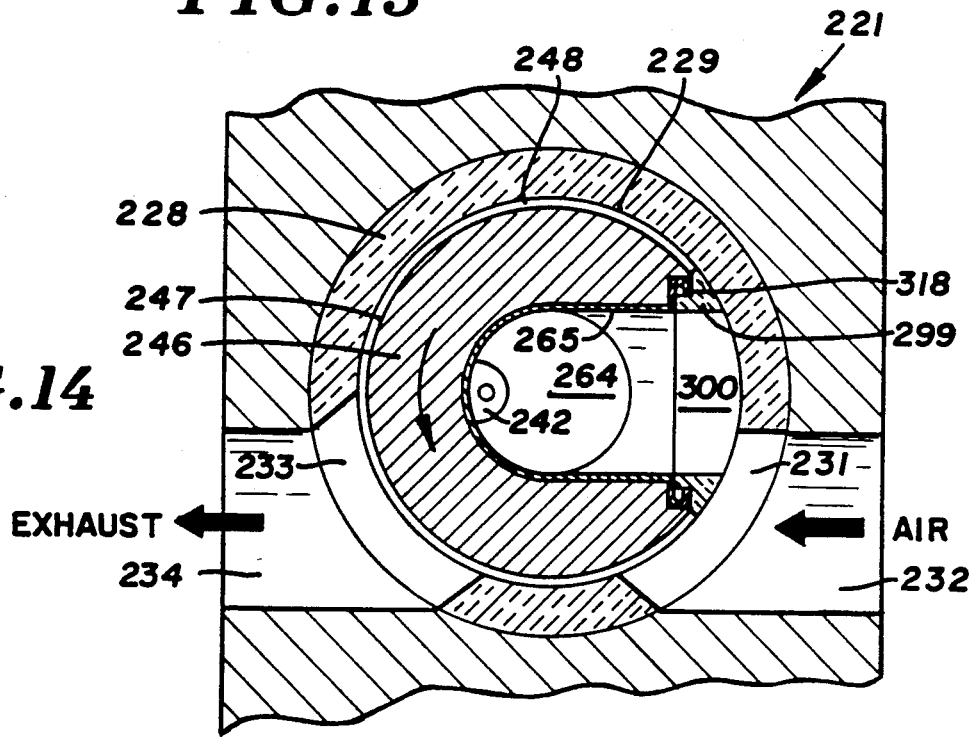
FIG. 14 is a sectional view taken along line 14—14 of FIG 12.

Referring to FIGS. 12 to 14 there is shown a modification of the engine 200 and valve assembly indicated generally at 227 of the internal combustion engine 200. Valve assembly 227 and parts of the engine 200 that are the same as the parts of engine 10 have the same reference number with the prefix 2.

Engine 200 has a block 211 having four upright cylinders or bores 212. The number of bores in block 211 can vary according to the design of the engine. Each of the bores accommodates a piston 213. Piston 213 is slidably located in bores 212 and connected to a conventional crankshaft with a connecting rod (not shown). As shown in FIG. 12, a head plate 217 is located on top of block 211. A gasket 215 is located between the bottom of plate 217 and the top of block 211. Head plate 217 has a circular opening 218 aligned with the central vertical axis of bore 212. As shown in FIG. 12, head plate 217 has a side hole 321 accommodating part of a fuel injector 243. Injector 243 has a nozzle 242 terminating in a discharge end 245 operable to direct atomized fuel 322, such as gasoline or diesel fuel, into valving combustion chamber 264. The top of piston 213 has a radial groove 215 for nozzle 242. Head plate 217 reduces the thrust forces on the valve assemblies and reduces the quenched volume of the air/fuel mixture adjacent to the valving combustion chambers. Substantially all of the air/fuel mixture in the valving combustion chambers is exposed to flame fronts with a result in reduction of HC emssions and improved fuel economy.

A head indicated generally at 221 is located on top of head plate 217. A plurality of head bolts 222 secure head 221 and head plate 217 to block 211. Head 221 has a plurality of vertical bores 223 accommodating rotary valve assemblies indicated generally at 227 for directing the flow of air/fuel mixture into the rotary valving combustion chambers, exposing the air/fuel mixture to an ignition spark, directing the burning and expanding gases into the expansion chambers, and controlling the flow of exhaust gases out of the valving combustion chambers and expansion chambers. Rotary valve assembly 227 is identical in structure and function to the other rotary vave assemblies of the engine. The following description is directed to rotary valve assembly 227.

Referring to FIGS. 12 and 14, rotary valve assembly 227 has a cylindrical sleeve 228 positioned in the bottom of bore 223. The lower end of sleeve 228 bears against the top of head plate 217. Sleeve 282 is a circular cylindrical member having an inside cylindrical surface 229, an intake port 231, and exhaust port 233. Intake port 231 is aligned with intake passage 232 located in head 221. Exhaust ports 233 is aligned with exhaust passage 234 in head 221 opposite passage 232. Sleeve 228 can be removed from bore 223 to facilitate servicing and repair of the engine. The location of the circumferentially spaced edges 231A, 231B and 233A, 233B of sleeve 228 forming the intake port 231 and exhaust port 233 can be changed to adjust the timing of the valve events. Replacement of sleeve 228 with an alternative sleeve which has appropriate edge locations, such as vertical edges allow the engine to be designed for different efficient operating speeds. Sleeve 228 can be a ceramic material, such as silicon nitride, silicon carbide, or a ceramic including silicon, aluminum, oxygen, nitrogen, and other materials. A sleeve 228 of ceramic material functions as a head insulator to restrict the dissipation of head to head 221. Sleeve 228 can also be made of other materials, such as metal, carbon or the like.

Returning to FIG. 12, sleeve 228 is held in a fixed position against head plate 217 by ring 236 and spacer sleeve 237 located in bore 223. A cap 238 engagable with sleeve 237 holds ring 236 and sleeve 237 and sleeve 238 in bores 223. Cap 238, sleeve 237, ring 236, and sleeve 228 can be machined from a single peice of metal. A plurality of bolts 239 secure cap 238 to the top of head 221. Cap 238 is removable from head 221 to allow the entire valve assembly to be withdrawn from head 221. This is accomplished without removal of head 221 from block 211 or removal of the intake and exhaust manifolds.

A cylindrical valve body 246 is located within sleeve 248. Body 246 has an outside cylindrical wall 247 positioned in space continguous relation relative to inside wall 246 of sleeve 248. An annular cylindrical space 248 separate the outside cylindrical wall 247 from inside wall 229 of sleeve 228. Sleeve 228 surrounds the entire outside of body 246. Wall 247 of body 246 does not have a precise machine finish as it does not engage wall 229 of sleeve 228. In other words, there is no frictional relationship between walls 246 and 229. The bottom of body 246 has a flat bottom surface 249 facing head plate 217. Surface 249 can have a ceramic coating to enhance its wear characteristics. The entire body 246 can be made from a ceramic or metal.

As shown in FIG. 12, head plate 217 has an annular groove surrounding opening 218. A ring seal 252 located in the groove is biased with a circular spring 253 into engagement with the bottom surface 249 of the valve body 246. Seal 252 is a pressure active face seal that has a high unit load on bottom surface 249 during the compression and power strokes of piston 213. The high unit load is effected by transfer of high pressure gasses into the annular space surrounded by circular spring 253. Seal 252 is preferrably made of ceramic material to enhance its wear and temperature characteristics. Alternatively, a split ring located in an annular groove and head plate 217 engagable with seal 252 along with a spring in the groove can be used to hold seal 252 in sliding sealing engagement with the bottom surface 249 of valve body 246.

Valve body 246 has a generally flat top wall 254 facing the bottom of member 236. An upright tubular shaft or stem 256 is intergral with the center portion of top wall 254 and extends upwardly through the ring 236 and cap 238. Bearings 266 and 267 surrounding shaft 256 rotatably mount the shaft on ring 236 and cap 238. A lip seal 257 is interposed below bearing 266 and has sealing engagement with the outside surface of the shaft 256. The center of body 246 has an upright threaded bore 258 that accommodates the threaded end of a spark plug 259. The spark plug 259 is located within the upright passage 261 of shaft 256. The lower end of spark plug 259 has spaced electrodes 262 and 263 located in center portion of the top of combustion chamber 264 located within the valve body 246. The walls 265 surrounding chamber 264 are coated with ceramic material. Shaft 256 is rotated with a gear 268 located between ring 236 and cap 238. A key 269 secures gear 268 to shaft 256. A worm gear 271 logitudinally extended along the length of head 221 in a side horizontal chamber 273 functions to simultaneously rotate all of the gears thereby concurrently rotate all of the valve bodies of the engine. A cover plate 274 conceals the worm gear 271 within the chamber 272. A plurality of bolt 276 secure cover plate 274 to head 21. Worm gear 271 is driven at a 2 to 1 speed ratio relative to rotated with a belt and pulley power rotation of the crank shaft with suitable drive structure, such as belt and pulleys.

A sleeve for ignition rotor 281 extends down into passage 261 of shaft 256. As shown in FIG. 12, sleeve 282 has a vertical hole 282 that accommodates a pair of conductor rods 283 and 284 biased from each other with a coil spring 286. Sleeve 281 is nonconducting material such as plastic. The lower end of sleeve 281 fits over the top of spark plug 259 so that conductor 283 engages the top conductor 287 of the spark plug. Conductor 284 contacts a head of a bolt 288 secured to a plastic ignition cover 289. A plurality of bolts 291 secure ignition cover 289 to the top of cap 238. Ignition wires or cables connect ignition cover 289 to the ignition system (not shown) of the engine. The cable has wires that electrically connected to bolt 288.

Sleeve 281 has a generally circular head 293 located below ignition cover 289. A lip seal 298 is located below head 293 between ring 238 and stem 256 to prevent contamination of bearing 267.

As shown in FIGS. 12 to 14, a segment seal 299 having a passage 300 is mounted on valve body 246 in alignment with the inlet of the combustion chambers 264. The segment seal 299 engages the inner surface 229 of sleeve 228 to provide an effective low friction seal. The valve body 246 has a front pocket 301 that accommodates segment seal 299. Outwardly directed arcuate lips 302 and 303 are located above and below pocket 301. Lip 302 has a recess 303 vertically aligned with a recess 304 in lip 303.

The segment seal 299 has a body 308 of ceramic metal or like material. Body 308 has an outer convex face that has a generally rectangular contact surface 311 surrounding the inlet of the passage 300. Oppositely directed post 312 and 313 are secured to the top and bottom portions of the body 308. The top and bottom circumferential land surfaces are concentric with the outer surfaces of posts 312 and 313. The land and post surfaces have the same radius of curvature. This radius of curvature is slightly larger than the radius of curvature of the outer surface 247 of the valve body 246. The radius of curvature of land and post surfaces is complementary to the radius of curvature of the inner surface 229 of sleeve 228. The back side of body 108 has a cylindrical boss 117 that fits into the couter bore 107. A seal 318 is located in a counter bore in the back of body 308, as seen in FIG. 14, to bias the segment seal into sealing engagement with the inner surface 229 of sleeve 229 and seal the small space between the inner side of body 308 and the valve body 246.

Returning to FIG. 12, valve body drive is operable to rotate worm gear 271 thereby simultaneously turn the valve bodies in a two to one time rotation with the rotation of crank shaft. Worm gear 271 is rotatably mounted on head 221 with suitable bearings (not shown) and has helical threads or worm threads in driving engagement with gear 268 to turn the valve bodies 246. The valve bodies of engine 200 are identical in structure to the valve body shown in FIGS. 3 to 11 including the segment seal 299 carried by the valve body. Each valve body 246 has a valving combustion chamber or passage 264 accommodating an air/fuel mixture which is burned in the chmber. The burning of pending gases flow to the expansion chamber 218. Exhaust gasses flow back thrugh chamber 264 into the exhust manifold. Chamber 264 is open to the passage 300 and the combustion chamber 230 via the opening 218 in the head plate 217. Segment seal 299 has outer contact surfaces on the lands and rim seal surface 311 that are in sliding sealing contact with the inside surface 229 of sleeve 228. The remaining outer surface of the body 308 is relieved. In other words it is not in surface contact with the inner surface 229 of sleeve 228. The outer surface 247 of valve body 246 is spaced by space 248 from the inner surface 229 thereby minimizing the resistance to rotation of valve body 246 within sleeve 228. The seal 318 is a pressure activated annular seal that provides sealing forces proportional to the pressure acting on the seal. As the sealing forces increase, the contact unit loads increase correspondingly at all segment seals inerfaces. Conversly, as the pressure acting within the segment seal decreases, the sealing forces and resulting unit loads decrease. Seal 318 is free to move to accommodate relatively run out between valve body 246 and the ported sleeve 228 such that segment seal 299 maintains constant surface contact with inside surface 229 of sleeve 228. Segment seal 299 ensures that the annular clearance 248 between valve body 246 and sleeve 228 is not filled with a fuel/air mixture. This substantially reduces the unburned fuel/air mixture in the combustion chamber 264. When the valve in combustion chamber 264 is aligned with the intake port 231 intake air is supplied to the valving chamber 264 and the expansion chamber 231 as piston 213 is moving down in a downward direction. As the valve body 246 continues to rotate piston 13 moves in an upward compression stroke the fuel injector 243 introduces a selected amount of fuel into the valving combustion chamber 264 via opening 218 in head plate 217. The piston 213 as it moves upwardly compresses the air/fuel mixture in valving combustion chamber 264. The ignition system is then operated to generate a spark in valving combustion chamber 264. The air/fuel mixture in chamber 264 commences to burn with a frame front emanating from spark plug electrodes 262 and 263. The rotating valve body 246 with the combustion chamber 264 provides for stratification of the air/fuel mixture due to the centrifical effects of the richer portion of the mixture which is burned by the flame as it moves through the combustion chamber 264. Seal 252 prevents the air/fuel mixture from entering the annular chamber 248 surrounding valve body 246. This seal is a pressure activated seal which floats with respect to the valve body 246. The geometry of valving combustion chamber 264 allows for the intake and exhaust gases to flow to and from the working or piston chamber 230 with minimal restrictions.

Engine 200 can be operated as a diesel engine. The ignition system is used to assist starting of the engine. The fuel injector operates to introduce fuel into the valving combustion chamber at the completion of the compression stroke of piston 213.

The valve body 246 along with spark plug 259 can be removed as a unit from head 221. Screws 239 attaching cap 238 to head 221 are removed. Valve body 246 along with spark plug 259, ring 236 and cap 238 are removed as a unit from head 221. The intake and exhaust manifolds, fuel injectors, and ignition system of the engine as well as parts of the cooling system are not disturbed during the removal and servicing of the valve assembly.

While there has been shown and described preferred embodiments of the internal combustion engine, rotary valve assembly and seals thereof, it is understood that changes in the structure, materials, and arrangement of structure can be made by those skilled in the art without departing from the invention. The invention is defined in the following claims.

The embodiments of the invention in which an exclusive property or privilege is claimed are defined as follows:

1. A rotary valve assembly for an internal combustion engine comprising: a housing having a bore, a gas inlet passage and a gas outlet passage open to the bore, a continuous cylindrical sleeve means located in said bore, said sleeve means having an inner surface and ports aligned with said passages, rotatable means located within said sleeve means for controlling the flow of gas into and out of the assembly, said rotatable valving means having a valving chamber open to means to accommodate a gas and the inner surface of the sleeve means, said rotatable valving means having a valve body, spark generating means mounted on said body in communication with said valving combustion chamber operable to ignite flue therein, said valving chamber having an inner portion located in the valve body, said valve body having an outer surface spaced from the inner surface of the sleeve means, segment seal means mounted on the valve body for rotation therewith, said segment seal means being engageable with the inner surface of the sleeve means, said segment seal means having a hole aligned with an outer portion of the valving chamber, cooperating pin and slot means on said segment seal means and valve body and allow the segment seal means to move about an axis generally parallel to said inner surface of the sleeve means, biasing means located between the valve body and seal means to hold the seal means to hold the seal means into engagement with the inner surface of the sleeve means, and means operable to rotate said rotatable having means whereby said valving passage sequentially moves into alignment with said ports allowing gas to flow in said inlet and outlet gas passages.

2. The assembly of claim 1 wherein: the cylindrical sleeve means has a cylindrical inside surface and the segment seal means is a member having an outside surface portion engageable with the inside surface of the sleeve means.

3. The assembly of claim 1 wherein: said valve body has a circumferential outwardly directed upper lip and a lower lip, said segment seal means being located between said lips, said cooperating pin and slot means comprising a slot in each lip and pin means secured to the valve body extended into the slots.

4. The assembly of claim 1 wherein: the axis of movement of segment seal means is generally parallel to the axis of rotation of the valve body.

5. The assembly of claim 1 wherein: the cylindrical sleeve means is a ceramic member.

6. The assembly of claim 5 wherein: the segment seal means is a ceramic member.

7. A rotary valve assembly for an internal combustion engine comprising: housing means having an inner surface and fluid inlet and outlet ports open to the inner surface, rotatable valving means located within the housing means for controlling the flow of fluid into and out of the assembly, said rotatable valving means having a valving chamber open to means to accommodate a fluid, said rotatable valving means having a valve body, spark generating means mounted on said body in communication with said valving chamber operable to ignite fuel therein, said valve body having an outer surface spaced from the inner surface of the housing means, segment seal means mounted on the valve body engageable with said inner surface of said housing means, said segment seal means having a passage in communication with the second chamber and open to said inner surface to allow fluid to flow into and out of said second chamber, cooperating pin and slot means on said seal means and valve body to move the seal means with the valve body and allow the seal means to move about an axis generally parallel to said inner surface of the housing means, biasing means located between the valve body and seal means to hold the seal means into engagement with the inner surface of the housing means, and means operable to rotate said valve body whereby said valving chamber sequentially moves into alignment with said ports allowing fluid to flow in said fluid inlet and outlet ports into and out of said chamber in the valve body.

8. The assembly of claim 7 wherein: the seal means is a ceramic member.

9. The assembly of claim 7 wherein: the seal means has a first outside surface portion surrounding the outer portion of the valving passage engageable with the inside surface of the housing means, and a second surface portion adjacent the first outside surface portion spaced from said inside surface of the housing means.

10. The assembly of claim 7 wherein: said valve body has a circumferential outwardly directed upper lip and a lower lip, said segment seal means being located between said upper and lower lips, said cooperating pin and slot means comprising a slot in each lip and pin means secured to the valve body extended into the slots.

11. The assembly of claim 7 wherein: the axis of movement of the segment seal means is generally parallel to the axis of rotation of the valve body.

12. The assembly of claim 7 wherein: said housing means includes a sleeve having said inner surface, said sleeve having air intake port and an exhaust gas port open to the air intake passage and exhaust gas passage respectively.

13. The assembly claim 12 wherein: said segment seal means is a ceramic member and said sleeve is a cylindrical ceramic member.

14. An internal combustion engine comprising: a block having cylindrical wall means surrounding at least one piston chamber, piston means located in said piston chamber, means operable to reciprocate the piston means in said chamber, a head plate located on the block over the piston chamber, said head plate having an opening in communication with said chamber, head means mounted on the head plate covering said opening, means securing the head means and head plate to the block, said head means having an air intake passage and an exhaust gas passage, rotary valve means operatively associated with the head means for controlling the flow of air into said piston chamber and the flow of exhaust gas from said piston chamber, said head means having a housing with an inner surface and bore open to said piston chamber, said valve means having a body located in said bore, said body having a valving combustion chamber continuously open to said opening and sequentially open to said air intake passage and exhaust gas passage, spark generating means mounted on said body in communication with said valving combustion chamber operable to ignite fuel in said combustion chamber, seal means mounted on the valve body, said seal means having a passage providing an outer portion of the valving combustion chamber, said outer portion of the valving chamber being sequentially aligned with said air intake passage and the exhaust gas passage during rotation of the valve body, means mounted on said head plate operable to introduce fuel into the valving combustion chamber, and means operable to rotate each of said valve body in timed relation with the movement of the piston means whereby said engine has an intake, compression, power, and exhaust strokes.

15. The engine of claim 14 wherein: said housing includes a sleeve having said inner surface, said sleeve having an air intake port and an exhaust gas port open to the air intake passage and exhaust gas passage and the outer portion of the valving chamber respectively.

16. The engine of claim 14 wherein: said valve body has a circumferential outwardly directed upper lip and a lower lip, said seal means being located between said upper and lower lips, said lips and seal means having cooperating means allowing the seal means to move relative to the valve body.

17. The engine of claim 14 wherein: said head plate has hole means open to one side thereof and said opening to said piston chamber, said means mounted on the head plate includes fuel injector means having a portion thereof located in said hole means operable to dispense fuel into the air in the valving combustion chamber.

18. The engine of claim 14 wherein: the means mounted on the head plate includes fuel dispensing means mounted on the head plate operable to dispense fuel into the air in the valving combustion chamber.

19. The engine of claim 14 including: a seal member between the valve body and head plate surrounding the opening in the head plate to block the flow of intake gas and exhaust gas into the space between the valve body and inner surface of the housing of the head means.

20. An internal combustion engine comprising: a block having cylindrical wall means surrounding at least one piston chamber, piston means located in said piston chamber, means operable to reciprocate the piston means in said chamber, a head plate located on the block over the piston chamber, said head plate having an opening in communication with said chamber, head means mounted on the head plate covering said opening, means securing the head means and head plate to the block, said head means having an air intake passage and an exhaust gas passage, rotary valve means operatively associated with the head means for controlling the flow of air into said piston chamber and the flow of exhaust gas from said piston chamber, said head means having a housing with an inner surface and bore open to said piston chamber, said valve means having a body located in said bore, said body having a valving combustion chamber continuously open to said opening and sequentially open to said air intake passage and exhaust gas passage, spark generating means mounted on said body in communication with said valving combustion chamber, operable to ignite the fuel therein, annular first seal means surrounding said valving combustion chamber between said body and said head plate, second segment seal means mounted on the valve body, said segment seal means having a passage providing an outer portion of the valving combustion chamber, said outer portion of the valving chamber being sequentially aligned with said air intake passage and exhaust gas passage during rotation of the valve body, cooperating pin and slot means on said segment seal means and valve body to move the segment seal means with the valve body and allow the segment seal means to move about an axis generally parallel to said inner surface of the housing, biasing means located between the valve body and segment seal means to hold the segment seal means in engagement with the inner surface of the housing, means operable to introduce fuel into the valving combustion chamber, and means operable to rotate each of said valve body in timed relation with the movement of the piston means whereby said engine has an intake, compression, power, and exhaust strokes.

21. The engine of claim 20 wherein: said segment seal means has a first outside surface portion surrounding the outer portion of the valving passage engageable with the inside surface of the housing, and a second surface portion adjacent the first outside surface portion spaced from said inside surface of the housing.

22. The engine of claim 20 wherein: said segment seal means has an outside surface portion surrounding the outer portions of the valving passage and engageable with the inside surface of the housing, and land means located adjacent the outside surface portion engageable with the inside surface of the housing.

23. The engine of claim 20 wherein: said valve body has a circumferential outwardly directed upper lip and a lower lip, said segment seal means being located between said upper and lower lips, said cooperating pin and slot means comprising a slot in each lip and pin means secured to the valve body extended into the slots.

24. The engine of claim 20 wherein: the means for introducing fuel into the valving combustion chamber includes a fuel injector mounted on the head means operable to dispense fuel into the air in the combustion chamber.

25. The engine of claim 20 wherein: the means for introducing fuel into the valving combustion chamber includes fuel dispensing means mounted on the head plate operable to dispense fuel into the air in the valving combustion chamber.

26. The engine of claim 20 wherein: said head plate has hole means open to one side thereof and said opening to said piston chamber, fuel injector means having a portion thereof located in said hole means operable to dispense fuel into the air in the valving combustion chamber.

27. The engine of claim 20 wherein: the axis of movement of segment seal means is generally parallel to the axis of rotation of the valve body.

28. The engine of claim 20 wherein: said housing includes a sleeve having said inner surface, said sleeve having an air intake port and an exhaust gas port open to the air intake passage and exhaust gas passage respectively.

29. The engine of claim 28 wherein: said segment seal means is a ceramic member and said sleeve is a cylindrical ceramic member.

30. An internal combustion engine comprising a block having at least one cylindrical wall surrounding a cylinder, piston means located in said cylinder, means operable to reciprocate the piston means in said cylinder, head means mounted on the block covering said cylinder, said head means having an intake passage for intake gas, an exhaust gas passage for exhaust gas, and a cavity which is open to the cylinder, open to said passages, and which accommodate a rotary valve assembly, said valve assembly comprising a valve body located within said cavity, the valve body having a valving combustion chamber and an outer surface spaced from the inner surface of the cavity to enable the valve body to rotate and thereby control the flow of intake gas from said intake passage into said rotary valve assembly and the cylinder an the flow of exhaust gas out of the rotary valve assembly and the cylinder to said exhaust gas passage, such flow occurring via said valving combustion chamber in the valve body open to the cylinder and said inner surface of the cavity, first seal means mounted on the valve body having a hole in alignment with an outer portion of the valving combustion chamber and the inlet and outlet passage, said first seal means having a surface surrounding the hole located in sliding sealing engagement with an arcuate section of the inner surface of the cavity, first means on the valve body adjacent the first seal means, second means on the first seal means cooperating with the first means for moving the first seal means with the valve body and allowing limited movement of the first seal means relative to the body to maintain the sealing relationship between the surface of the first seal means that engages the inner surface of the cavity, second seal means located between the first seal means and valve body to block the flow of the intake gas, and exhaust gas into the space between the outer surface of the valve body, third seal means cooperating with said valve body to block the flow of the intake gas, and exhaust gas into the space between the valve body and inner surface of the cavity, ignition means comprising spark generating means mounted on the valve body operable to initiate combustion in the valving chamber, and means operable to rotate the rotatable valve body and first seal means in timed relation with the movement of the piston means whereby said engine has intake, compression, power, and exhaust strokes.

31. The engine of claim 30 wherein: a head plate having an opening in communication with the cylinder and valving combustion chamber, and said third seal means is an annualar seal means between the head plate and the valve body, said annular seal means surrounding said opening.

32. The engine of claim 31 wherein: said annular seal means includes an annular face seal for sealing engagement with the valve body and means for biasing the face seal into said engagement.

33. The engine of claim 30 including: biasing means located between the valve body and first seal means to bias the latter into engagement with the cavity inner surface.

34. The engine of claim 30 wherein: the second seal means is a circular seal surrounding the valving combustion chamber and engageable with the valve body and the first seal means to bias the latter into engagement with the cavity inner surface.

35. The engine of claim 34 wherein: the circular seal includes an annular face seal for engagement with the valve body and means for biasing the face seal into said engagement.

36. The engine of claim 34 including: a ring shield located inwardly of the circular seal between the valve body and the seal means.

37. An internal combustion engine comprising: a block having at least one cylindrical wall surrounding a piston chamber, piston means located in said piston chamber, means operable to reciprocate the piston means in said chamber, head means mounted on the block covering said chamber, said head means having an air intake passage, an exhaust gas passage, a rotary valve assembly operatively associated with the head means for controlling the flow of air into the rotary valve assembly and piston chamber and the flow of exhaust gas from rotary valve assembly and the piston chamber, said head means having a housing with a bore open to the piston chamber accommodating said rotary valve assembly, said valve assembly comprising a cylindrical sleeve located in said bore, said sleeve having an inner surface and intake and exhaust ports aligned with said intake passage and exhaust gas passage, rotatable valving means located within said sleeve for controlling the flow of intake gas into said rotary valve assembly and piston chamber and the flow of exhaust gases out of the piston chamber and rotary valve assembly, said rotatable valving means having a valving combustion chamber open to the piston chamber and the inner surface of the sleeve, said rotatable valving means having a valve body, said valving combustion chamber having an inner portion located in the valve body, means for introducing fuel into the valving combustion chamber, said valve body having an outer surface spaced from the inner surface of the sleeve, spark generating means mounted on said valve body in communication with said valving combustion chamber operable to ignite the fuel therein, segment seal means mounted on the valve body, said segment seal means having a passage aligned with an outer portion of the valving combustion chamber, said outer portion of the valving chamber being sequentially aligned with said intake and exhaust ports during rotation of the valve body, cooperating pin and slot means on said segment seal means and valve body to move the segment seal means with the valve body and allow the segment seal means to move about an axis generally parallel to said inner surface of said sleeve, means located between the valve body and segment seal means to bias the segment seal means into engagement with the inner surface of the sleeve, and means operable to rotate said rotatable valving means in timed relation with the movement of the piston means whereby said engine has an intake, compression, power, and exhaust strokes.

38. The engine of claim 37 wherein: the cylindrical sleeve is a ceramic member.

39. The engine of claim 37 wherein: the segment seal means is a ceramic member.

40. The engine of claim 37 wherein: said segment seal means has an outside surface portion surrounding the outer end of the valving passage and engageable with the inside surface of the sleeve, and land means located adjacent the outside surface portions engageable with the inside surface of the sleeve.

41. The engine of claim 37 wherein: said valve body has a circumferential outwardly directed upper lip and a lower lip, said segment seal means being located between said upper and lower lips, said cooperating pin and slot means comprising a slot in each lip and pin means secured to the valve body extended into the slots.

42. The engine of claim 37 wherein: the means for introducing fuel into the valving combustion chamber includes a fuel injector mounted on the head means operable to dispense fuel into the air in the valving combustion chamber.

43. The engine of claim 37 wherein: the axis of movement of segment seal means is generally parallel to the axis of rotation of the valve body.

44. The engine of claim 37 wherein: the cylindrical sleeve has a cylindrical inside surface and the segment seal means is a seal member having an outside convex surface portion engageable with the inside surface of the sleeve.

45. The engine of claim 44 wherein: said seal member has a first outside surface portion surrounding the outer portion of the valving combustion chamber engageable with the inside surface of the sleeve, and a second outside surface portion adjacent the first outside surface portion spaced from said inside surface of the sleeve.

46. The engine of claim 37 including: a head plate located between said block and head means, said head plate having an opening to said piston chamber aligned with the valving combustion chamber in the valve body.

47. The engine of claim 46 including: annular seal means between the head plate and valve body, said annular seal means surrounding said opening.

48. The engine of claim 46 wherein: the means for introducing fuel into the valving combustion chamber includes fuel dispensing means mounted on the head plate operable to dispense fuel into the gas in the valving combustion chamber.

49. The engine of claim 46 wherein: said head plate has hole means open to one side thereof and open to said piston chamber, fuel injector means having a portion thereof located in said hole means operable to dispense fuel into the gas in the valving combustion chamber.

50. The engine of claim 46 wherein: the piston means has an upright projection locatable in said opening when the piston means has completed the compression stroke.

51. The engine of claim 50 wherein: said projection has groove means to promote movement of the gas and fuel in the valving combustion chamber.

* * * * *